US008291824B1

(12) United States Patent
Welle et al.

(10) Patent No.: US 8,291,824 B1
(45) Date of Patent: Oct. 23, 2012

(54) MONOLITHIC EXPLODING FOIL INITIATOR

(75) Inventors: Eric J. Welle, Niceville, FL (US); Paul T. Vianco, Albuquerque, NM (US); Paul S. Headley, Cedar Crest, NM (US); Jason A. Jarrell, Rio Rancho, NM (US); J. Emmett Garrity, Albuquerque, NM (US); Keegan P. Shelton, Sandia Park, NM (US); Stephen K. Marley, Tijeras, NM (US)

(73) Assignee: Sandia Corporation, Albuquerque, NM (US)

( * ) Notice: Subject to any disclaimer, the term of this patent is extended or adjusted under 35 U.S.C. 154(b) by 153 days.

(21) Appl. No.: 12/832,097

(22) Filed: Jul. 8, 2010

Related U.S. Application Data

(60) Provisional application No. 61/223,849, filed on Jul. 8, 2009.

(51) Int. Cl.
*F42C 19/02* (2006.01)

(52) U.S. Cl. ..... 102/202.8; 102/202.9

(58) Field of Classification Search ..... 102/202.7, 102/202.8, 202.9, 202.11, 202.12, 218
See application file for complete search history.

(56) References Cited

U.S. PATENT DOCUMENTS

| | | | | |
|---|---|---|---|---|
| 4,840,122 | A | 6/1989 | Nerheim | |
| 4,862,803 | A | 9/1989 | Nerheim et al. | |
| 5,088,413 | A * | 2/1992 | Huber et al. | 102/202.5 |
| 5,731,538 | A | 3/1998 | O'Brien et al. | |
| 6,178,888 | B1 | 1/2001 | Neyer et al. | |
| 6,234,081 | B1 | 5/2001 | Neyer | |
| 6,470,802 | B1 | 10/2002 | Neyer et al. | |
| 7,571,679 | B2 | 8/2009 | Nance | |
| 7,581,496 | B2 | 9/2009 | Hennings et al. | |
| 8,020,489 | B2 * | 9/2011 | Maeda et al. | 102/202.11 |
| 2002/0023567 | A1 | 2/2002 | Riviere et al. | |
| 2002/0092438 | A1 * | 7/2002 | Makowiecki et al. | 102/205 |
| 2008/0083343 | A1 * | 4/2008 | Maeda et al. | 102/202.4 |
| 2008/0148982 | A1 | 6/2008 | Hennings et al. | |

* cited by examiner

*Primary Examiner* — Stephen M Johnson
(74) *Attorney, Agent, or Firm* — Carol I. Ashby

(57) ABSTRACT

A monolithic exploding foil initiator (EFI) or slapper detonator and the method for making the monolithic EFI wherein the exploding bridge and the dielectric from which the flyer will be generated are integrated directly onto the header. In some embodiments, the barrel is directly integrated directly onto the header.

11 Claims, 5 Drawing Sheets

MONOLITHIC EXPLODING FOIL INITIATOR

This patent application claims priority benefit from U.S. provisional patent application Ser. No. 61/223,849, filed on Jul. 8, 2009, which is incorporated herein by reference.

The United States Government has rights in this invention pursuant to Department of Energy Contract No. DE-AC04-94AL85000 with Sandia Corporation.

BACKGROUND OF THE INVENTION

This invention relates to a slapper detonator useful for detonating high explosives. Conventionally, most slapper detonators are based on a non-integrated design where a pre-fabricated exploding foil initiator (EFI)/slapper chip is sandwiched between a chip spacer and a barrel. This assembly is then soldered onto a header with a 2-pin feed-through. A problem associated with such modular slapper detonators is the potential for unreliable operation due to failure of the electrical connections between the EFI/slapper chip and the header. Conventionally, electrical connections are formed by soldering. However, it is important to perform this soldering at low temperature to avoid degradation of the dielectric overcoat from which the flyer is generated by the vaporization of the bridge of the EFI. Failure of the solder connections due to materials aging and/or manufacturing defects can lead to unreliable operation of conventional slapper-detonator designs. There is a need for a new approach to slapper detonator design that avoids such problems. The monolithic slapper detonator (monolithic exploding foil initiator) of this present invention can be expected to yield greater reliability of operation and higher yields of devices meeting performance specifications compared to previous modular designs. An additional benefit of the monolithic device embodiments of this present invention is that it is expected to represent a configuration that is more readily survivable in high-g-force environments.

BRIEF DESCRIPTION OF THE DRAWINGS

The accompanying drawings, which are incorporated in and form part of the specification, illustrate some embodiments of the present invention and, together with the description, serve to explain the principles of the invention.

DETAILED DESCRIPTION OF THE INVENTION

This invention comprises a monolithic exploding foil initiator (EFI) or slapper detonator and the method for making the monolithic EFI wherein the exploding bridge and the dielectric from which the flyer will be generated are integrated directly onto the header. Optionally, the barrel may be integrated directly onto the header.

Figure 1A:
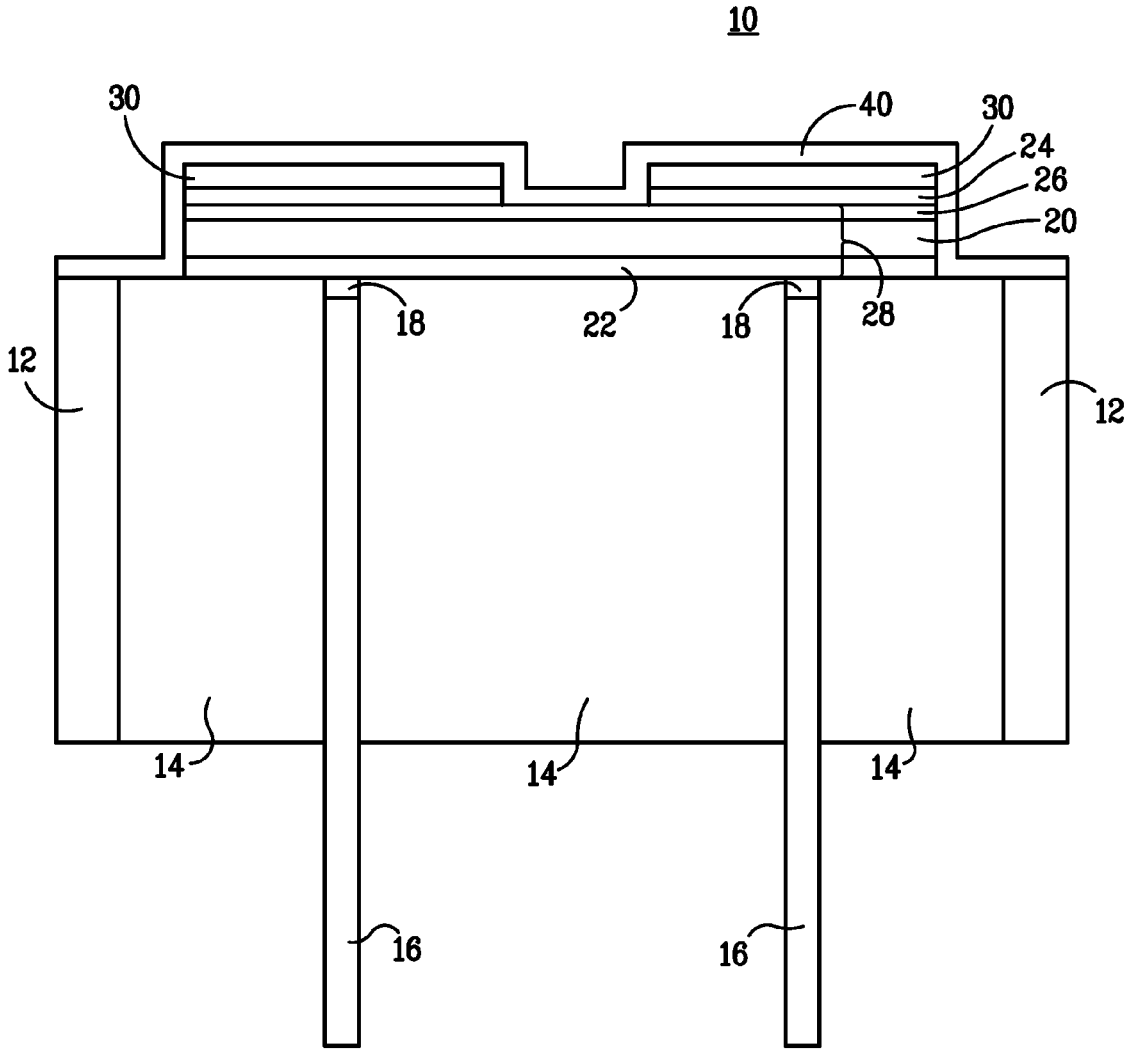
FIGS. 1*a*-1*c* illustrate cross-sectional views of some embodiments of the monolithic exploding foil initiator.
Figure 1B:
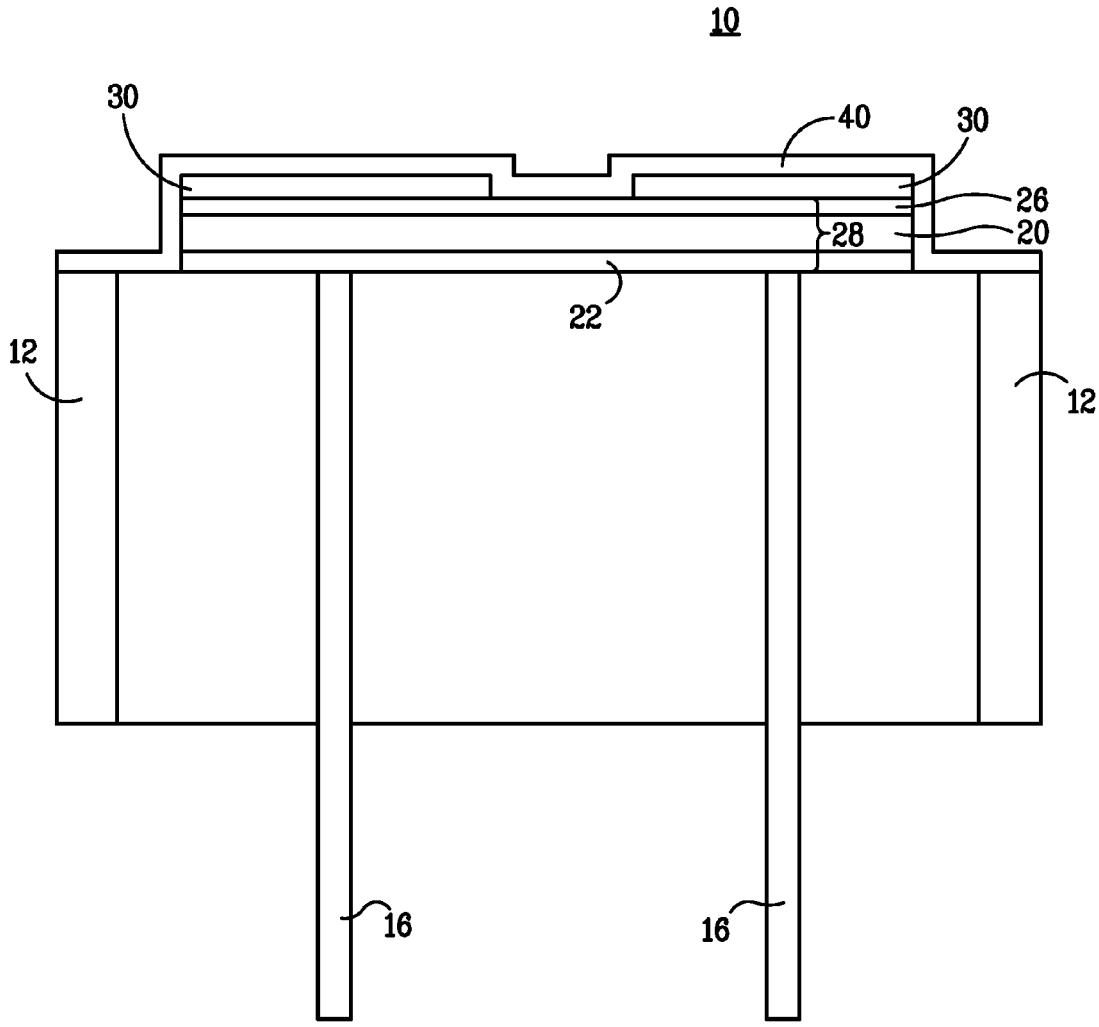

FIGS. 1*a*-1*c* and FIGS. 2*a*-2*b* illustrate some embodiments of the invention. Elements are not drawn to scale in the figures. The header 10 comprises a housing 12 surrounding an insulator 14 through which at least two conductive pins 16 extend. A wide range of material combinations of the housing (both metal and non-metal) and of the insulator (glass, ceramic, polymeric, etc.) can be employed in various embodiments of this invention. The header functions as the support structure and the electrical connection structure for a given embodiment. The housing can comprise a metal or a non-metal, a conductive material or an insulating material. In some embodiments, the housing and the insulator can be an integrated unit comprising the same material. The conductive pins that penetrate the insulator element of the header provide electrical contact between the initiator metal structure that is formed on the top surface of the header and a current source that will be attached to the monolithic EFI to provide current for actuation. The pins can be of any material that will provide sufficient electrical connectivity to allow rapid passage of current through the bridge portion of the metal initiator structure to actuate the EFI functionality. In some embodiments, the pins 16 may comprise be a monolithic material. In other embodiments, such as is illustrated in FIG. 1*a*, a portion 18 of one or more of the pins in contact with the initiator metal structure may be of a different composition than the rest of the pin. For example, in some embodiments, the main body of the pin may be of any conductive metal and the top contact portion 18 of the pin may be gold or other material that will make good electrical contact to the overlying layers.

Embodiments illustrated in the figures are shown to be generally circular-cylindrical. However, it is to be understood that a wide variety of header shapes are also suitable for employment in embodiments of this invention, including structures with a top surface that is rectangular, polygonal, or comprising a curved shape, including shapes of low symmetry. The sidewall of the header is not constrained to be approximately perpendicular to the top surface of the header.

The insulator 14 can be any suitable material, including but not restricted to a glass, a ceramic, and a polymer. The housing 12, when metal, can comprise a wide range of metals. In some embodiments, the metal housing comprises Kovar metal that forms a good glass-to-metal seal with a glass insulator.

The bridge metal 20 is atop a portion of the surface of the insulator 14 and is in electrical contact with the pins (16, 18). An adhesion layer 22 is optionally present between the bridge metal 20 and the insulator 14 surface. For many metals, Ti serves as a suitable adhesion layer metal, but other adhesion metals can be employed, including but not restricted to Cr, Hf, Ta, W, Si, and Zr. In some embodiments, Al is employed as the bridge metal; other metals suitable for rapid heating to vaporization can be used in alternative embodiments. Examples include but are not restricted to Al, Cu, Ag, Ni, Ni alloys, and Ni/Cr alloys (e.g., Nichrome). If fabrication using common deposition processes such as those employed in semiconductor processing is desired, Al is a convenient choice since it is a common semiconductor metallization with well-established thin-film processing protocols. In some embodiments, it may be desirable to optionally apply an additional layer 26 between the bridge metal and the dielectric. This layer may serve as an adhesion layer and/or it may serve to protect the chemical integrity of the bridge metal over time, making operation of the device more reliable. In the embodiments illustrated in FIG. 1*a*-1*c*, adhesion layers 22 and 26 are shown, but there need not be an adhesion layer in one or both locations in some embodiments. A common adhesion promoting layer comprises Ti, but other compositions may also be employed, including but not restricted to Cr, Hf, Ta, W, and Si.

In some embodiments, it may be desirable to have a diffusion barrier 24 between the bridge metal 20 and the conductive pads 30. In embodiments where the bridge metal is Al and the conductive pads are Au, a Pd layer serves as a good diffusion barrier. The layer 24 termed a diffusion barrier may serve functions other than preventing diffusion of material between the contact, pads 30 and the bridge metal layer 20. These functions include serving as a barrier to corrosion, oxidation, diffusion, singly and in combination. Examples of some suitable materials to use for the diffusion barrier include but are not restricted to Pd, Pt, Ni, Pd/Ni, Fe, Co as well as nitrides, silicides, and oxides of Ti, Hf, and Ta.

In some embodiments, it may be desirable to include an adhesion layer 26 between the bridge metal layer 20 and the diffusion barrier layer 24. The decision to include an adhesion layer or a diffusion layer in a particular embodiment will depend on the metallurgical and chemical properties of the materials selected for use as the bridge metal layer 24 and the conductive pads 30. A suitable selection is within the skill of those knowledgeable in the metallurgical arts of thin film deposition.

The bridge layer 28 comprises the bridge metal layer 20 and optionally the adhesion layers 22 and 26 and the diffusion barrier layer 24. Some suitable patterns of the bridge layer are illustrated in the perspective view of FIG. 2*a* and the plan view of FIG. 2*b*. The pattern comprises pad regions that will under lie the conductive pads 30 and a bridge 32 that is sufficiently narrow to funnel the electrical current being passed from the first pad to the second pad through the bridge at a current density that will actuate the exploding foil initiator. The initiator metal structure comprises the bridge layer and the conductive pads. In various embodiments, a bridge structure is formed wherein the bridge dimension is such as to constrict current flow between the two pins during device operation to sufficiently high current densities that the bridge vaporizes in such a manner as to be able to generate a flyer from the overlying dielectric. Suitable dimensions can be readily determined for a particular current source that is to be employed during operation of the device.

At least one feedthrough pin 16 is in electrical contact with each of the pad regions of the bridge layer to enable passage of current through the bridge 32 to actuate the device.

Conductive pads 30 are formed atop the pad regions of the bridge layer. Examples of metals that may be employed are conductive materials with a density greater than the density of the bridge layer, including but are not restricted to Au, W, and Pt. Materials suitable for the adhesion layer function include but are not restricted to W, Ta, Ti, Zr, Si, and Hf.

A variety of methods may be employed for forming the various layers of metal in the initiator metal structure. One method of forming the patterns of the initiator metal structure comprises steps of depositing one or more of the metal layers followed by etching the desired pattern into the metal layer or metal layers. Another method of forming the patterns comprises using a lift-off metallization process. Combinations of deposition/etching, patterned lift-off, and physical mask/magnet processing may be employed in forming the initiator metal structure.

In some embodiments, the process of forming the bridge layer and the conductive pads uses a magnetic physical mask technique. After positioning the header in a process fixture, a magnetically susceptible mask embodying the desired pattern is placed on the top surface of the assembly and aligned relative to the header surfaces. A magnet is then placed on the backside of the assembly to hold the mask against the surface of the assembly comprising the fixture and the headers. Regions of the header where deposition is desired are exposed through openings in the magnetic mask. The assembly is then placed in a vacuum chamber and metallization of the bridge layer is performed using, for example, a vapor deposition process. The vapor deposition process can be a physical vapor deposition or a chemical vapor deposition. The first mask comprising the bridge layer pattern is replaced with a second mask comprising the conductive pad pattern. The conductive pad layer is then deposited using a suitable vapor deposition process.

A dielectric layer 40 is applied atop at least the bridge 32 portion of the metal initiator structure. The flyer of the EFI is generated and ejected upon passage of the actuating current through the bridge. In some embodiments, the dielectric layer may extend over all or part of the initiator metal structure. In some embodiments, it may extend over all or part of the exposed surface of the insulator 14. In some embodiments, it may extend over the surface of the housing 12. In some embodiments, the dielectric layer can serve an additional function of providing mechanical and environmental protection to all or part of the initiator metal structure.

The dielectric layer can comprise a variety of materials. It is to be of a composition and thickness suitable for ejection of a flyer upon passage of the actuating current through the bridge. Suitable ranges of dielectric thickness are known to those of skill in the slapper detonator art. Examples of some suitable materials include but are not restricted to parylene, polyimide, epoxy, epoxy-acrylate resin, and solder resist. Depending on the dielectric layer that is employed in a particular embodiment, a variety of methods can be employed to deposit the dielectric. Examples of suitable methods include but are not restricted to vapor deposition, spin-coating, flood-screen coating, curtain coating, electrostatic spraying, and air-spraying.

In some embodiments, deposition of the dielectric layer may employ vapor deposition of parylene. Alternative dielectric materials may also be employed. In one such embodiment, after metallization layers are completed, the assembly can be placed in a vacuum chamber where parylene deposition takes place. In some embodiments, it may be desirable to include an adhesion promoter either prior to deposition of parylene in either an ex-situ or in-situ implementation.

Figure 3A:
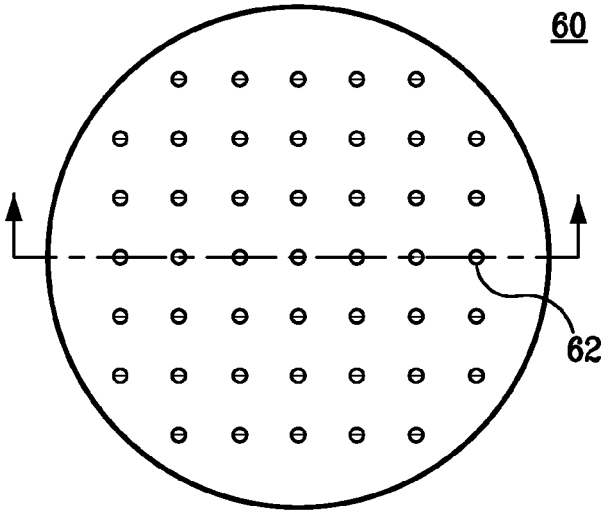
FIGS. 3A, 3B, and 3C illustrate various views of an embodiment of a processing fixture used for the deposition processes employed in fabrication of some embodiments of the monolithic exploding foil initiator. Additional fixture configurations may also be employed.
Figure 3B:
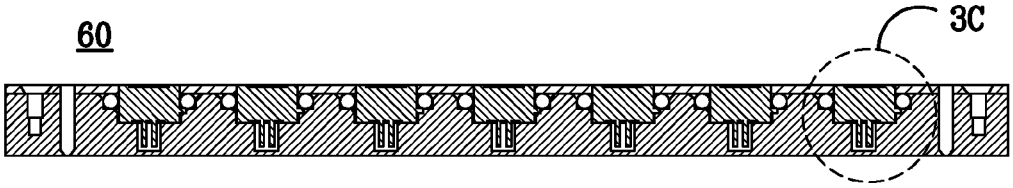
Figure 3C:
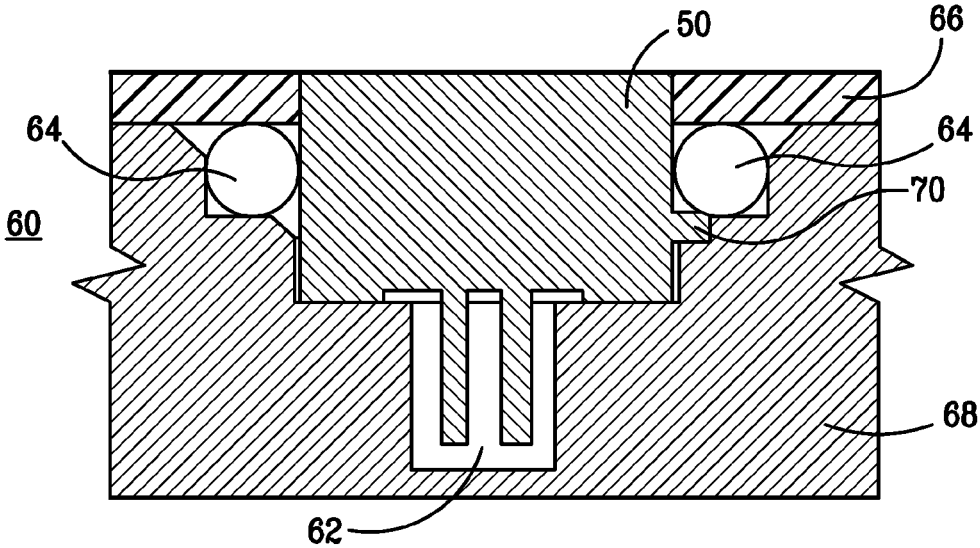

The monolithic character of the exploding foil initiator of the present invention enables the fabrication of numerous components in a parallel process instead of individually. In corn embodiments, sequential deposition of the various metal film layers and the dielectric can be performed with the header mounted in a processing fixture that holds a plurality of headers for simultaneous fabrication of a plurality of monolithic EFIs. An embodiment of such a fixture is presented in FIG. 3. FIG. 3*a* illustrates a plan view of a fixture 60 suitable for mounting in many types of film deposition and/or etching equipment. This embodiments is substantially circular in geometry because many types of processing equipment are configures for holding substantially circular substrates, such as semiconductor wafers. Other embodiments of the processing fixture may vary widely in geometric shape (shapes other than substantially circular) and in the number and arrangement of the wells 62 into which a header will be placed for processing. Such variations are intended to be considered as embodiments of this invention. FIG. 3*b* presents a cross section of the fixture in FIG. 3*a*. FIG. 3*c* presents an enlarged view of a single well 62 with a header 50 mounted therein. The header 50 is represented schematically in these figures without illustration of complete details of the construction of the header. In some embodiments, the header can have substantially vertical sidewalls. In other embodiments, the header may have slanted sidewalls or nonlinear sidewalls. In some embodiments, one or more projections 70 may project from the sidewalls of the header. In various embodiments, the projections may be at different locations along the side of the header ranging from at or near the header surface that will receive deposition to the end of the header with projecting pins. In various embodiments, the projections can extend around the entire perimeter of the header or the projections can extend a portion of the way around the perimeter. In some embodiments, one or more discrete projections may be present around the perimeter. When there are a plurality of discrete projections, they may or may not lie in a single plane that bisects the header. In this embodiment, the header 50 is held in position by an o-ring 64. The combination of a shoulder feature 70 on the perimeter of the header (one type of projection 70 that extends around substantially the entire perimeter) and the o-ring can act as a barrier to protect the pins from moisture penetration that could potentially cause galvanic corrosion of the pins during processing. This feature also allows for pin alignment with the masks for deposition of metals. Alternative methods for positioning the header may also be employed. Examples include but are not restricted to spring clips, or using an epoxy and assembly surface polish technique. In some embodiments, a perforated face plate 66 may be placed atop the fixture body 68 to provide a surface substantially aligned with the surface of the header to facilitate uniform film deposition. This face plate also serves to hold the individual headers uniformly in place as well as compresses the gasket for sealing the pin cavity against substantial the migration of moisture. The fixture design can allow alignment features for ease of later processing steps as well as features that provide ease of assembly and disassembly of the fixture and the monolithic exploding foil initiators. Numerous openings are provided in the top plate for the exposure of the surface of the header to deposition and/or etching.

FIG. 2 illustrates top and perspective views of two embodiment showing the bridge, conductive contact pads, and pin locations. Alternative geometries can be employed for the conductive contact pads.

Figure 1C:
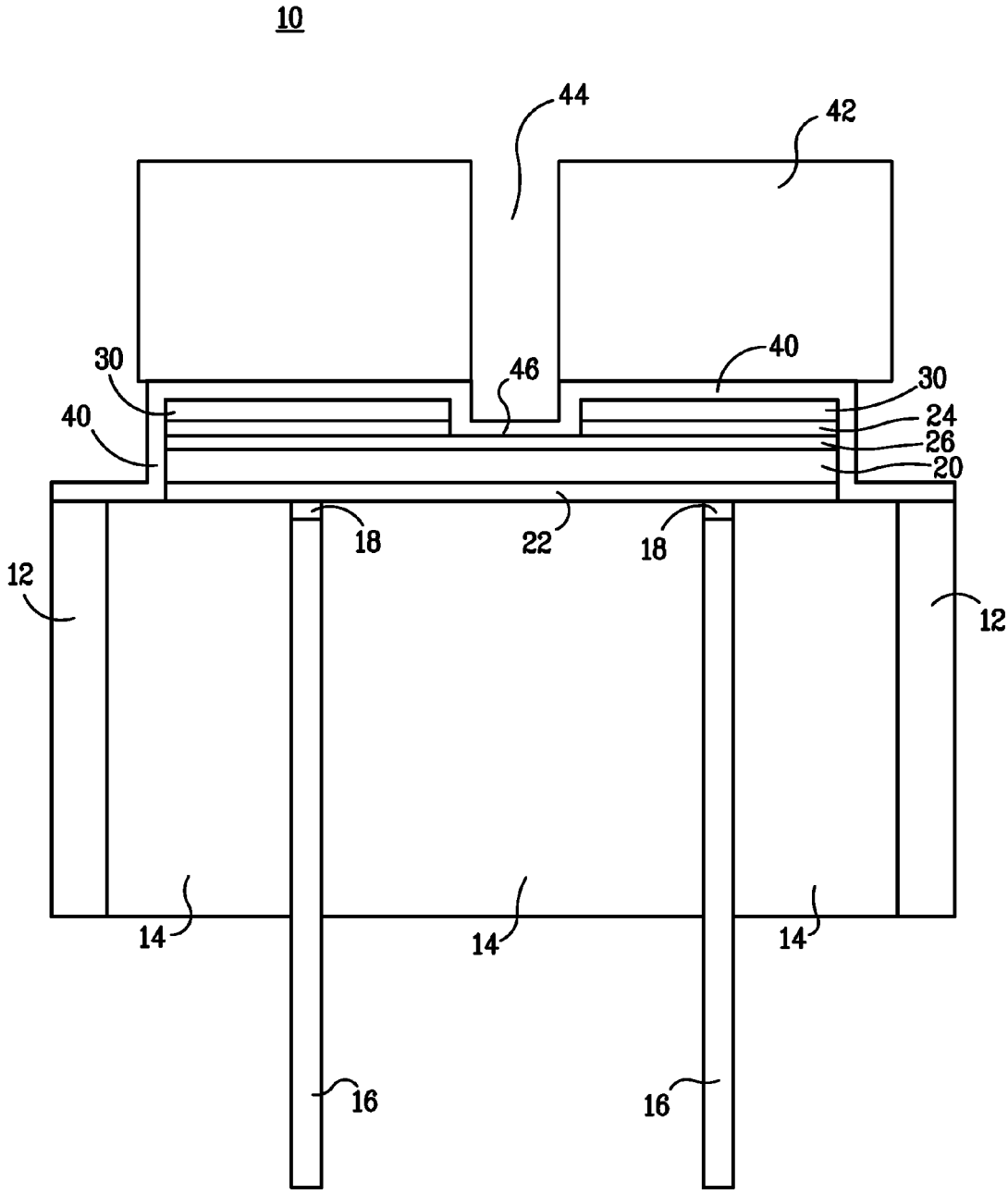

In the embodiment illustrated in FIG. 1*c*, the dielectric is located atop the structure, with a portion of the dielectric that will become the flyer during operation lying atop the bridge. A barrel 42 is located atop the dielectric layer with a bore 44 aligned to allow passage of the flyer generated from the dielectric layer in the region over the bridge 46. The barrel may be monolithically integrated atop the dielectric layer or may be a separate element suitably affixed to the device. A variety of methods may be employed for forming an integrated barrel. In some embodiments, a photodefinable material may be coated onto the surface and patterned using photolithographic techniques to form a barrel directly atop the dielectric layer of the monolithic exploding foil initiators.

The bridge structure is made in the following fashion in some embodiments. Other process sequences that produce analogous structures can also be used in fabrication of embodiments of this invention. A metal layer that will be used to form the bridge is deposited. This layer comprises the metal that forms the primary bridge metal. Additional metal layers that facilitate adhesion or environmental protection can also be deposited as part of the total bridge structure. For example, a layer of Ti, Cr, Hf, Ta, W, Si and Zr, or other adhesion promoter can be applied atop the glass or ceramic header to facilitate adhesion of the bridge metal. Aluminum may be used as the bridge metal in this embodiment, but other metals capable of being rapidly heated to vaporize the bridge metal can also be employed. Examples include but are not restricted to Al, Cu, Au, Ag, Ni, Pt, alloys thereof, and Ni/Cr alloys (for example, Nichrome). In some embodiments, a metal adhesion layer (Ti in some embodiments) and a metal (Pd in some embodiments) that is resistant to corrosion or oxidation and/or which can serve as a diffusion/reaction barrier between metals and/or the dielectric that are deposited atop the bridge metal layer. The bridge structure can be defined by a number of different techniques, as are know to those of skill in the thin-film processing art. Examples include but are not restricted to ion etching, plasma etching of various types, patterned deposition and etching processes, metal lift-off techniques and physical mask techniques including but not restricted to magnetic physical mask techniques. The bridge has dimensions such that it can rapidly be heated to cause very rapid vaporization by the passage of an electrical current through the bridge between the two conductive pads.

Following formation of the bridge structure, metallic conductive pads are deposited. Gold is employed for conductive pads in some embodiments, but other metals can also be employed. A dielectric layer is deposited over the metal structures. The flyer will be generated from a portion of the dielectric layer that overlays the bridge structure. In one embodiment, the following layer types were employed: first adhesion layer: Ti; bridge-metal layer: Al; 2nd adhesion layer: Ti, corrosion/diffusion inhibition layer: Pd, metal conductive pad layer: Au, dielectric layer: parylene. The adhesions layers are up to a few tenths of a micrometer in thickness. The other metal layers are up to a few 10 s of micrometers in thickness. The dielectric layers are up to a few hundred micrometers thickness. Other dielectric materials and other thicknesses can be employed provided vaporization of the exploding bridge can cause ejection of a portion of the dielectric to serve as the flyer of the monolithic exploding foil initiator. Other metals can also be employed provided they produce a structure that can function as an exploding bridge. Other contact metals can be used. Optionally, an additional barrel structure can be applied atop the dielectric layer as a separate component or can be fabricated directly atop the structure described above. Barrel lengths (either separate or integrated) are varied from 0.009 to 0.040 in. (0.23-1 mm) in chip slapper devices depending on application. Other barrel lengths may be employed in some embodiments.

Figure 2A:
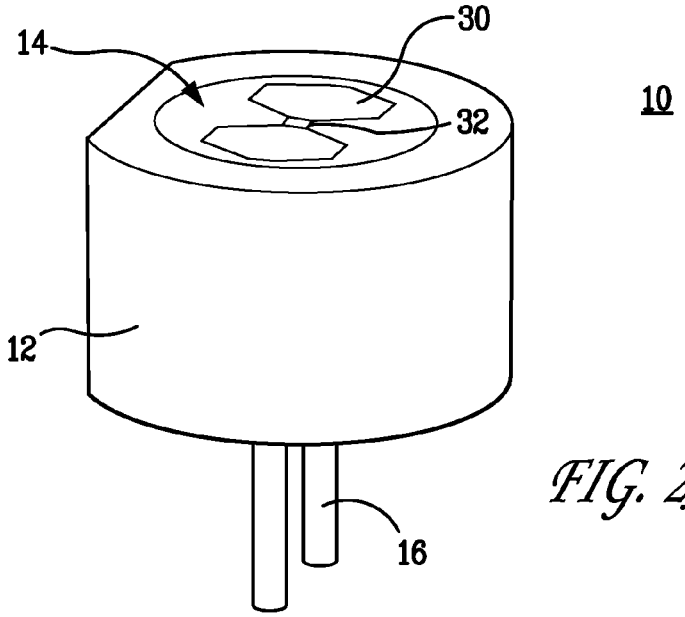
FIGS. 2A and 2B illustrate top and perspective views of two embodiments of the monolithic exploding foil initiator structure comprising a two-pin header and an initiator metal structure integrated directly onto the header. The dielectric layer from which a flyer is generated upon actuation is formed atop at least the bridge region of the initiator metal structure.
Figure 2B:
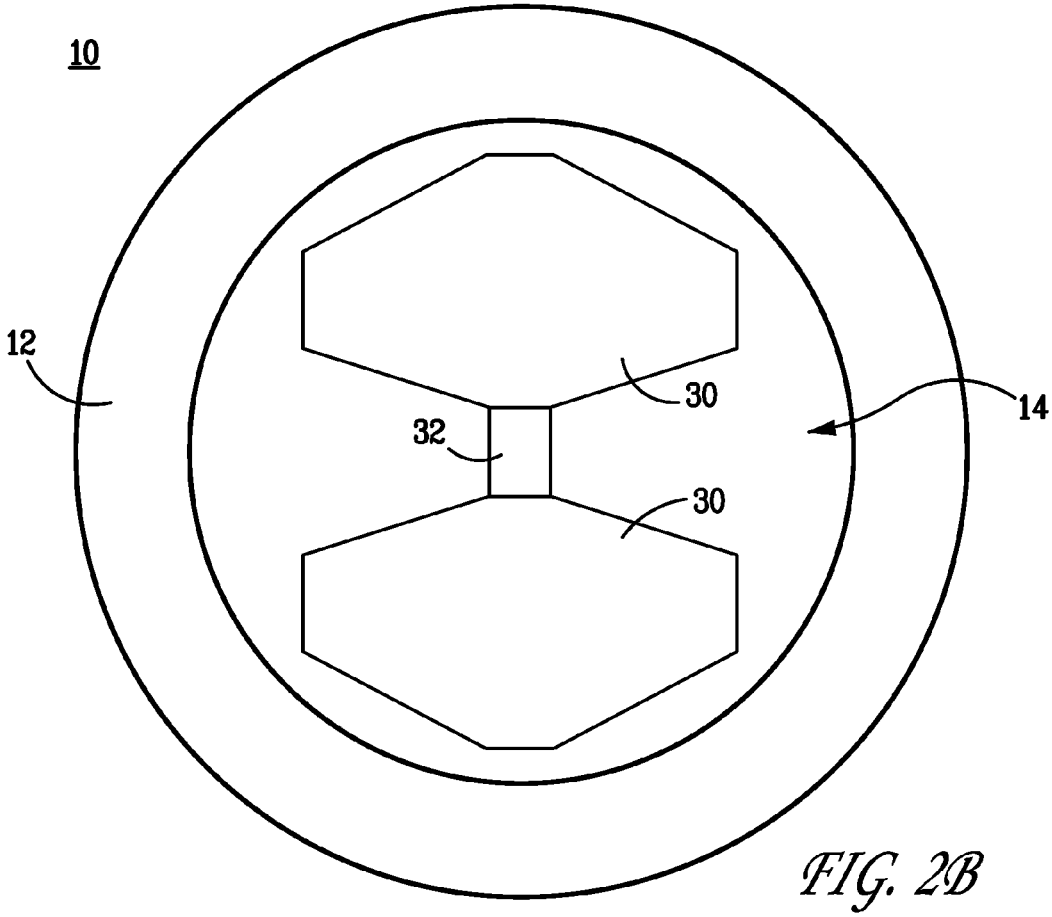

FIG. 2 illustrates a perspective view (FIG. 2*a*) of one embodiment employing a truncated circular-cylinder header and a top view (FIG. 2*b*) of a header of circular cross-section. Other header shapes may be used in other embodiments as desired.

Multiple monolithic exploding foil initiators can be fabricated simultaneously employing thin-film processing tools and techniques. One embodiment of a fixture for holding multiple headers during the fabrication process for some embodiments is illustrated schematically in FIG. 3.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A monolithic exploding foil initiator, comprising:

a header comprising a first feedthrough pin and a second feedthrough pin that are electrically isolated from each other and that penetrate an insulator element of the header, the insulator element having a top surface;

an initiator metal structure comprising a bridge layer affixed to the top surface of the insulator element, the bridge layer comprising a bridge metal layer and having a pattern comprising a first pad region, a second pad region, and a bridge connecting the first pad region and the second pad region, wherein the first pad region is in electrical contact with the first feedthrough pin and the second pad region is in electrical contact with the second feedthrough pin and further comprising a first conductive pad atop the first pad region and a second conductive pad atop the second pad region; and a dielectric layer covering at least the bridge of the initiator metal structure, the dielectric layer having a thickness suitable for ejection of a flyer upon passage of an actuating current through the bridge.

2. The monolithic exploding foil initiator of claim 1, further comprising a barrel atop the dielectric layer, wherein a bore of the barrel is aligned over the bridge and configured to allow passage of the flyer.

3. The monolithic exploding foil initiator of claim 1, wherein the bridge layer further comprises an adhesion layer between the bridge metal layer and the top surface of the insulator element.

4. The monolithic exploding foil initiator of claim 3, wherein the adhesion layer comprises an element selected from the group consisting of Ti, Cr, Hf, Ta, W, Si, and Zr.

5. The monolithic exploding foil initiator of claim 1, wherein the bridge layer further comprises a diffusion barrier layer between the bridge metal layer and the first and second conductive pads, and optionally an adhesion layer between the bridge metal layer and the diffusion barrier layer.

6. The monolithic exploding foil initiator of claim 5 wherein the diffusion barrier layer comprises a material selected from the group consisting of Pd, Pt, Ni, Pd/Ni, Fe, Co, titanium nitride, titanium oxide, hafnium nitride, hafnium oxide, tantalum nitride, tantalum oxide, zirconium nitride, and zirconium oxide.

7. The monolithic exploding foil initiator of claim 1, wherein the bridge metal layer comprises a metal selected from the group consisting of Al, Cu, Au, Ag, Ni, Pt, Ni/Cr, and alloys thereof.

8. The monolithic exploding foil initiator of claim 1, wherein the first and second conductive pads comprise a material selected from the group consisting of Au, W, and a conductive material with a density greater than a density of the bridge layer.

9. The monolithic exploding foil initiator of claim 8, wherein an adhesion layer between the bridge layer and the first and second conductive pads comprises an element selected from the group consisting of W, Ta, Ti, Zr, Si, and Hf.

10. The monolithic exploding foil initiator of claim 1, wherein the dielectric layer comprises a material selected from the group consisting of parylene, polyimide, epoxy, epoxy-acrylate resin, and solder resist.

11. The monolithic exploding foil initiator of claim 1, wherein the dielectric layer is a substantially continuous layer covering at least the bridge of the initiator metal structure and an exposed portion of the top surface of the insulator element adjacent to the initiator metal structure.

* * * * *